US007703204B2

(12) United States Patent
Sakiyama et al.

(10) Patent No.: US 7,703,204 B2
(45) Date of Patent: Apr. 27, 2010

(54) METHOD FOR MANUFACTURING A FLAT CABLE HARNESS

(75) Inventors: Koji Sakiyama, Sakura (JP); Takehisa Ide, Sakura (JP)

(73) Assignee: Fujikura Ltd., Tokyo (JP)

( * ) Notice: Subject to any disclaimer, the term of this patent is extended or adjusted under 35 U.S.C. 154(b) by 92 days.

(21) Appl. No.: 11/495,583

(22) Filed: Jul. 31, 2006

(65) Prior Publication Data

US 2006/0264091 A1 Nov. 23, 2006

Related U.S. Application Data

(62) Division of application No. 10/668,309, filed on Sep. 24, 2003, now Pat. No. 7,264,498.

(30) Foreign Application Priority Data

Sep. 27, 2002 (JP) ..... 2002-283932

(51) Int. Cl.
*H01R 43/04* (2006.01)

(52) U.S. Cl. ..... 29/863; 29/858; 29/861; 29/866; 439/404

(58) Field of Classification Search ..... 29/33 F, 29/33 M, 857, 858, 861, 863, 866, 868, 749, 29/753, 755; 174/72 A, 72 C, 117 F; 438/389–425
See application file for complete search history.

(56) References Cited

U.S. PATENT DOCUMENTS

| | | | | |
|---|---|---|---|---|
| 4,641,904 | A | 2/1987 | Kosugi et al. | |
| 4,808,114 | A | 2/1989 | Mohri et al. | |
| 4,839,962 | A * | 6/1989 | Long, Jr. | 29/753 |
| 4,870,752 | A * | 10/1989 | Brown et al. | 29/866 |
| 5,049,088 | A * | 9/1991 | Rishworth et al. | 439/417 |
| 5,242,314 | A | 9/1993 | Di Giulio et al. | |
| 6,273,746 | B1 | 8/2001 | Seko et al. | |
| 6,616,475 | B2 * | 9/2003 | Nagai | 439/395 |
| 6,832,930 | B2 | 12/2004 | Kubota et al. | |
| 2002/0009919 | A1 | 1/2002 | Yamanashi et al. | |

FOREIGN PATENT DOCUMENTS

| | | |
|---|---|---|
| EP | 0991139 A1 | 4/2000 |
| GB | 2141593 A | 12/1984 |
| JP | 58-38932 U | 3/1983 |
| JP | 5-205788 A | 8/1993 |
| JP | 7-272545 | 10/1995 |
| JP | 7-282870 | 10/1995 |

(Continued)

*Primary Examiner*—Donghai D. Nguyen
(74) *Attorney, Agent, or Firm*—Sughrue Mion, PLLC

(57) ABSTRACT

Among each of the conductors 4*a* to 4*e* that form the flat cable 2 of the flat harness 1, at the installation part of the relay connector 6, conductors 4*a* and 4*e*, conductors 4*a*1 and 4*a*2, and conductors 4*e*1 and 4*e*2 are respectively cut and separated, and then connected to the relay connection terminal 8. Thereby, the number of conductors 4 that form the flat cable 2 is decreased to a minimum, and thus it is possible to decrease the unnecessary amount of material. In addition, in the manufacturing steps, the crimping step of the flat cable 2 to the relay connector 6, the cutting step, and the molding step are carried out in one step, and thus the number of manufacturing steps can be decreased.

6 Claims, 13 Drawing Sheets

FOREIGN PATENT DOCUMENTS

| | | | |
|---|---|---|---|
| JP | 7-312239 | | 11/1995 |
| JP | 7-312241 | | 11/1995 |
| JP | 7-320545 | | 12/1995 |
| JP | 9-213383 | A | 8/1997 |
| JP | 10-136530 | | 5/1998 |
| JP | 10-136530 | A | 5/1998 |
| JP | 2000-133332 | | 5/2000 |
| JP | 2001-217014 | A | 8/2001 |
| JP | 2002-203431 | | 7/2002 |

* cited by examiner

METHOD FOR MANUFACTURING A FLAT CABLE HARNESS

CROSS REFERENCE TO RELATED APPLICATIONS

This is a divisional of U.S. application Ser. No. 10/668,309, filed Sep. 24, 2003, issued as U.S. Pat. No. 7,264,498, which claims benefit of priority to Japanese Patent Application, No. 2002-283932, filed on Sep. 27, 2002, the entire contents of which applications are incorporated by reference herein.

BACKGROUND OF THE INVENTION

1. Field of the Invention

The present invention relates to a flat harness formed by a flat cable (FC), a flexible flat cable (FFC), or the like, that connects electrical components (auxiliary machineries) mounted on a vehicle, for example, and in particular relates to a flat harness and a manufacturing method for the same that minimizes the materials and the number of manufacturing steps for the flat harness.

2. Description of the Related Art

Conventionally, wire harnesses have generally been used to connect electronic components (auxiliary machineries) of a vehicle or the like. The wire harness bundles electrical wires that connect auxiliary machineries into a harness configuration, and normally crimp-style terminals are installed on the end of each of the electrical wires that form the harness. The crimp-style terminals are built into the connector that is connected to the connectors provided on each of the auxiliary machineries. In addition to wire harnesses, flat harnesses in which the electrical wires can be arrayed into a flat configuration and arrange a plurality of wirings at regular intervals are frequently used.

However, as described above, because a flat harness has a structure in which a plurality of wirings are arrayed in parallel, the width of the harness becomes wider as the number of wires increases, and thus there are cases in which wiring installation at a narrow site becomes difficult.

Thus, the present applicants proposed a wiring method for a flat harness that can form an arbitrary number of circuit wires by cutting and eliminating a part of the wiring of the flat harness and forming a joint part made of an electrically conducting material, and can realize a decrease in the number of electrodes of the connector of the terminal part along with space-saving and a simplification of the structure of the connector by minimizing unnecessary wiring (for example, refer to Japanese Unexamined Patent Application, First Publication, No. Hei 10-136530).

However, in this wiring method, a number of operational steps are necessary to form the joint part because an arbitrary circuit must be formed after forming the joint part.

The present invention is performed to provide a flat harness and a manufacturing method for the same that further advances the object of realizing space saving and a simplification of structure by minimizing unnecessary wiring that has been proposed by the present applicants as described above, and an object of the present invention is to provide a flat harness and manufacturing method for the same which can minimize materials and manufacturing steps for the flat harness.

SUMMARY OF THE INVENTION

An embodiment of a harness of the present invention comprises: a cable in which a plurality of conductors are surrounded by an insulating covering and arrayed in a substantially flat configuration; and a plurality of connectors installed at a plurality of locations in the longitudinal direction of the cable and having connection terminals that connect to at least a part of the plurality of conductors, and connecting external circuits and the conductors via the connection terminals; and wherein at least a part of the plurality of connectors provides a plurality of connection terminals spaced at intervals along the conductor; the conductors to which these connection terminals have been connected are cut between the connection terminals, and the connection terminals disposed at both sides of cut parts of the conductors form respectively different circuits.

A manufacturing method for a harness that comprises a cable having a plurality of conductors covered by an insulating covering and arrayed in a substantially flat configuration; and a plurality of connectors installed at a plurality of locations in the longitudinal direction of the cable and having connection terminals that connect to at least a part of the plurality of conductors, and connecting external circuits and the conductors via the connection terminals; and wherein at least a part of the plurality of connectors provides a plurality of connection terminals spaced at intervals along the conductor, comprising: a connector installation step of installing the plurality of connectors at predetermined positions in the longitudinal direction of the cable such that the connection terminals and conductors are connected; and a conductor cutting step of cutting the conductors between the plurality of connection terminals that are spaced along conductors at a part wherein at least a part of the connector is installed, simultaneously or before the connector installation step.

According to the present invention, because the flat harness comprises the cable in which the plurality of conductors are surrounded by the insulating covering and arrayed in a flat configuration; and the plurality of connectors installed at a plurality of locations in the longitudinal direction of the cable and having connection terminals that connect to at least a part of the plurality of conductors, and connecting external circuits and the conductors via the connection terminals; and wherein at least a part of the plurality of connectors provides a plurality of connection terminals spaced at intervals along the conductor; the conductors to which these connection terminals have been connected are cut between the connection terminals; and the connection terminals disposed at both sides of cut parts of the conductors form respectively different circuits, it is possible to minimize the number of conductors of the cable that forms the flat harness. In addition, when installing the connectors on the cable, because the conductors between the connecting terminals that are disposed separated along the conductor are cut at a part where at least a part of the connector is installed simultaneously or before the installation, it is possible to decrease the number of manufacturing steps. Thereby, the materials for the flat harness can be decreased, and furthermore, it becomes possible to decrease the number of manufacturing steps for the flat harness.

Moreover, in the harness of the present invention, the cable that forms the flat harness may be a flat cable having a structure wherein each of the plurality of conductors is covered by an insulating covering and each of the insulating coverings is joined together, or a flexible flat cable having a structure wherein a plurality of conductors are covered by an insulating covering formed in a flat configuration by lamination or extrusion.

In addition, the connecting terminals may be crimp-style terminals having a crimping part which holds the insulating covering at the proximal end side and interposes and crimps the conductors therebetween.

Moreover, the connectors may comprise a connector housing; and a mold part that is formed on the end on one side of this connector housing and seals the proximal ends of the connection terminals which are connected to the conductors of the cable in the connector housing.

In addition, the cutting scraps of the cut conductors of the cable can be sealed in the connector housing by the mold part. Thereby, the process of removing the cutting scraps can be eliminated, and it is possible to prevent short circuits and the like due to the cutting scraps.

The cut and separated conductors of the cable can be sealed in the connector housing by the mold part in a state wherein the respective cut surfaces are bent so as not to contact or face each other. Thereby, it is possible to prevent the cut and separated conductors from short circuit therebetween.

Moreover, the connector housing of the connector installed at the part where the conductors have been cut may provide a positioning projection that is inserted into the cut part of the conductor and positions each of the conductors of the cable and the connection terminals. Thereby, during the connection between the connection terminals and the conductor, it is possible to offset the differences in the pitch of each of the conductors and the like.

In addition, the connector installation step may further include a molding step in which the proximal ends of the connection terminals connected to each of the conductors of the cable are sealed by mold.

In this case, the molding step may seal the cutting scraps of the conductors cut in the conductor cutting step with the proximal ends of the connection terminals.

In addition, the molding step may provide a bending step in which the conductors cut and separated in the conductor cutting step are bent so that the respective cut surfaces do not contact or face each other, and each of the bent conductors is sealed in an enclosed state.

Moreover, in the case that the connection terminals are crimping-style terminals having a crimping part in which the insulating coating is held at the proximal side and the conductors are interposed therebetween, the connector installation step may be a crimping step in which each of the conductors is interposed in the crimping part of the connection terminals and crimped.

DETAILED DESCRIPTION OF THE EXEMPLARY EMBODIMENTS

Figure 1:
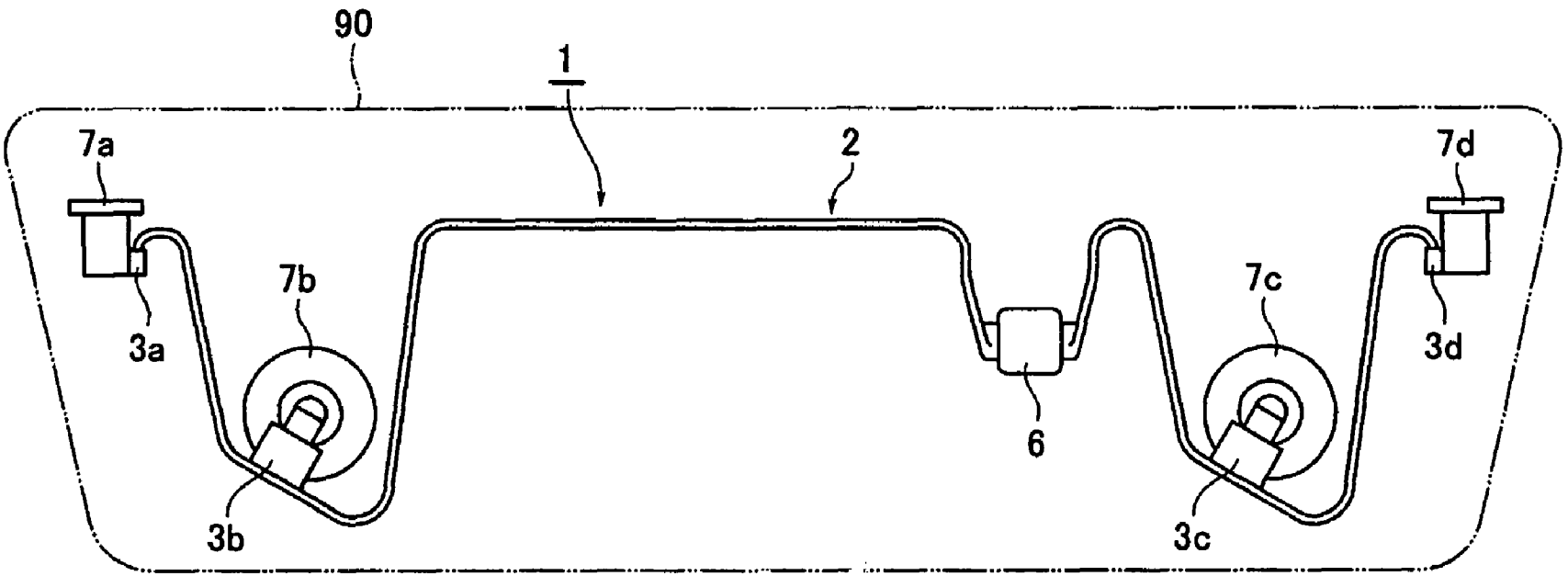
FIG. 1 is a simplified layout drawing showing the flat harness according to an embodiment of the present invention.
Figure 2:
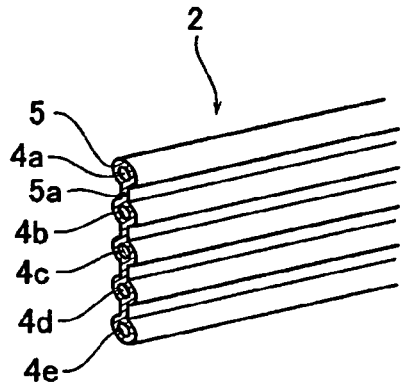
FIG. 2 is a partial exploded drawing of the flat harness according to an embodiment of the present invention.

Below, exemplary embodiments of the present invention will be explained with reference to the attached figures. The described exemplary embodiments are intended to assist the understanding of the invention, and are not intended to limit the scope of the invention in any way. FIG. 1 is a simplified layout drawing showing the flat harness according to an embodiment of the present invention. FIG. 2 is a partially exploded drawing of this flat harness.

The flat harness 1 comprises a flat cable 2 which is composed of a plurality of conductors covered by an insulating covering and arrayed in parallel to form a flat surface, a plurality of connectors 3*a*, 3*b*, 3*c*, and 3*d* which is mounted on this flat cable 2, and a relay connector 6 which is mounted at a predetermined position between both ends of this flat cable 2. The flat harness 1 is installed in a module 90 in which each of the auxiliary machineries 7*a*, 7*b*, 7*c*, and 7*d* providing connector connection parts that engage with the connectors 3*a* to 3*d*, and electrically connects each of the auxiliary machineries 7*a* to 7*d*. Connection terminals, described below, connected to the auxiliary machineries 7*a* to 7*d* are provided on the connectors 3*a* to 3*d*, and relay connection terminals, described below, connected to another harness are provided on the relay connector 6. In addition, a module part described below is respectively formed on the connection parts on the connectors 3*a* to 3*d*, the relay connection terminal of the relay connector 6, and the connection part between the relay connection terminal and the conductor of the flat cable 2.

As shown in FIG. 2, the flat cable 2 has a flat cable structure wherein conductors 4*a*, 4*b*, 4*c*, 4*d*, and 4*e* comprising a wire such as a single wire or stranded wire made of a rod-shaped conductor comprising, for example, Cu or Al, are covered by an insulating covering 5 comprising an insulating resin such as polyethylene terephthalate (PET), polyethylene naphthalate (PEN), polyolefin (PO), or the like, and each of the insulating coverings 5 is joined to each other by a bridge part 5*a* consisting of an insulating resin identical to that of the insulating covering 5. The flat cable 2 can also be a flexible flat cable having a structure wherein rectangular column shaped conductors are covered by an insulating covering 5 formed so as to be flat by a laminator or extrusion.

The connecting terminals are connected to predetermined connectors at the installation parts of the connectors 3*a* to 3*d* among each of the conductors 4*a* to 4*e* that form the flat cable 2, and each relay connection terminal is connected to the installation part of each of the conductors 4*a* to 4*e* that form the flat cable 2 and the relay connector 6. The connection terminals and the relay connection terminals are crimp-style terminals having a crimping part which holds the insulating covering 5 of the flat cable 2 at the proximal end, and the conductor is interposed and crimped in the crimping part. These connection terminals and the relay connection terminals are crimped to the conductor 4 in a predetermined connected state at the wiring installation portion of each of the connectors 3*a* to 3*d* and the relay connector 6.

Figure 3:
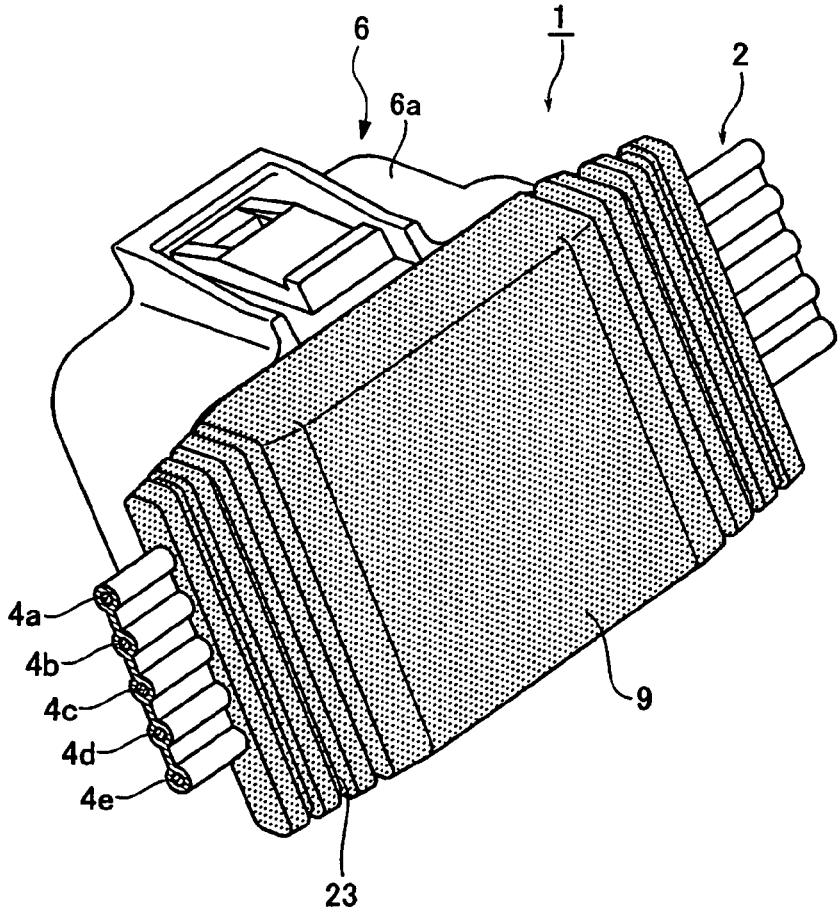
FIG. 3 is a perspective view showing the relay connector installation part in the flat cable of the flat harness according to an embodiment of the present invention.
Figure 4:
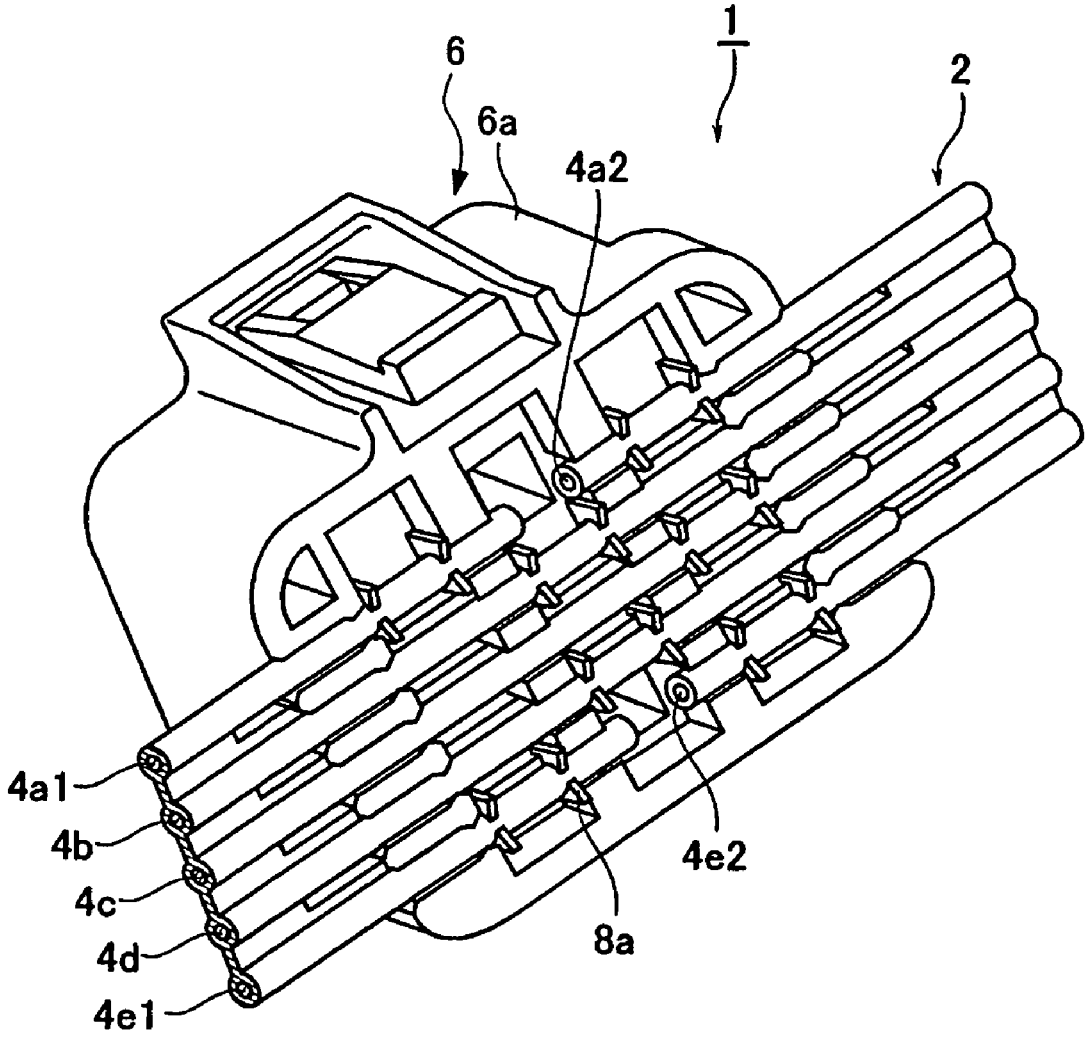
FIG. 4 is a perspective drawing showing the appearance of the mold part removed from the installation part in FIG. 3.

FIG. 3 is a perspective drawing showing the installation part of the relay connector 6, including a connector housing 6*a* including within the flat cable 2, and FIG. 4 is a perspective drawing showing the appearance when the mold part has been removed from this installation part. As shown in FIG. 3, the installation part of the relay connector 6 of the flat cable 2 is sealed by the mold part 9 that encloses the connection part between the relay connection terminal 8 (not illustrated) and each of the conductors 4*a* to 4*e* of the flat cable 2. It may appear that each of the conductors 4*a* to 4*d* are crimped to the relay connection terminal 8 in the installation part of the relay connector 6, but actually, as shown in FIG. 4, at the installation part of the relay connector 6, among these connectors 4*a* to 4*e*, conductors 4*a* and 4*e* are cut, conductor 4*a* is separated into 4*a*1 and 4*a*2, and conductor 4*e* is separated into 4*e*1 and 4*e*2, and then these are respectively crimped to the crimped part 8*a* of the relay connection terminal 8. Moreover, as shown in FIG. 3, the end of this mold part 9 adjacent to the end at which the flat cable 2 is exposed from the mold part 9 has a structure in which, in the direction perpendicular to the longitudinal direction of the flat cable 2, a plurality of grooves 23 are formed along this longitudinal direction, and by having a certain degree of freedom of bending imparted thereby, the severing of the wires of the flat cable 2 can be prevented.

Figure 5A:
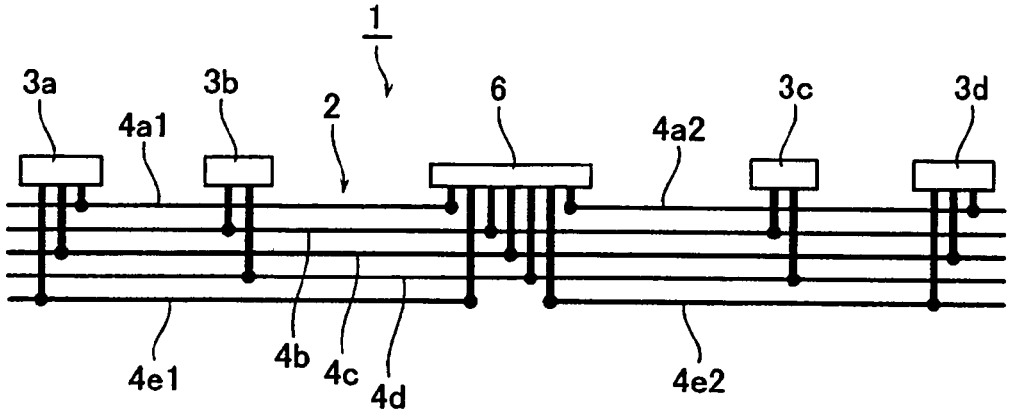
FIG. 5A is a circuit diagram of the flat harness according to an embodiment of the present invention.
Figure 5B:
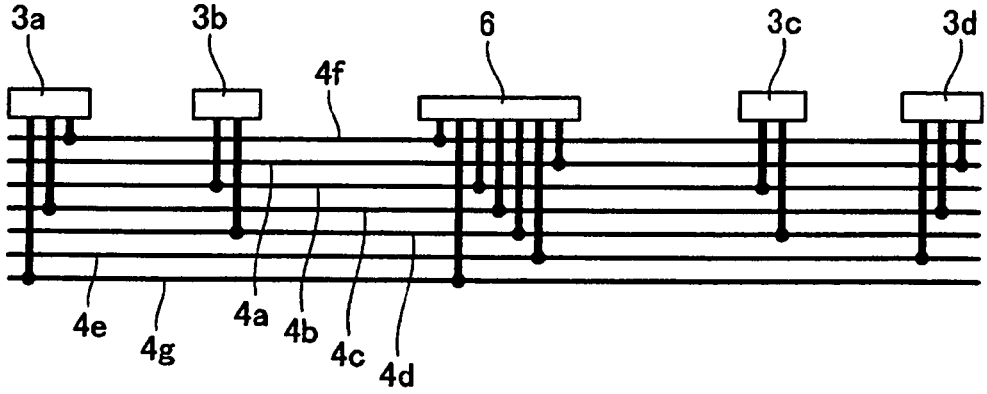
FIG. 5B is a circuit diagram of the flat harness according to an embodiment of the present invention.

FIG. 5A is a circuit diagram for this flat harness 1. For example, as shown in FIG. 5A, the connector 3*a* is connected to the conductors 4*a*1, 4*c*, and 4*e*1, connectors 3*b* and 3*c* are connected to conductors 4*b* and 4*d*, and connector 3*d* is connected to conductors 4*a*2, 4*c*, and 4*e*2. Conventionally, in order to realize this type of circuit structure, as shown for example in FIG. 5B, the number of conductors (4*a* to 4*g*, or 7 conductors) must be at least the same as the number of electrodes (7 electrodes) of the relay connector 6. However, in the flat harness 1 of the present invention, by cutting predetermined conductors at the installation part of the relay connector 6, it is possible to form a flat harness 1 by minimizing the number of conductors used in the flat cable 2. Thereby, it is possible to eliminate unnecessary material for conductors and the like in the flat cable 2 that forms the flat harness 1.

FIG. 6A to FIG. 7B are schematic drawings for explaining another conductor reduction state for the flat cable 2.

Figure 6A:
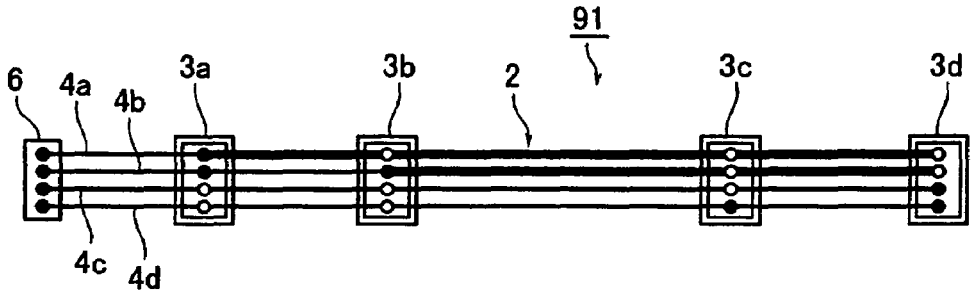
FIG. 6A is a schematic drawing for explaining another conductor reduction state of the flat cable.
Figure 6B:
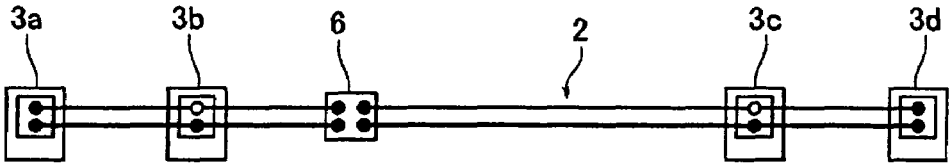
FIG. 6B is a schematic drawing for explaining another conductor reduction state of the flat cable.
Figure 7A:
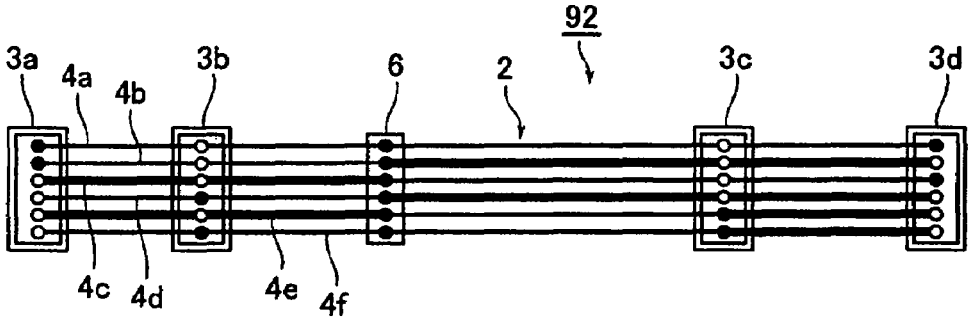
FIG. 7A is a schematic drawing for explaining another conductor reduction state of the flat cable.
Figure 7B:
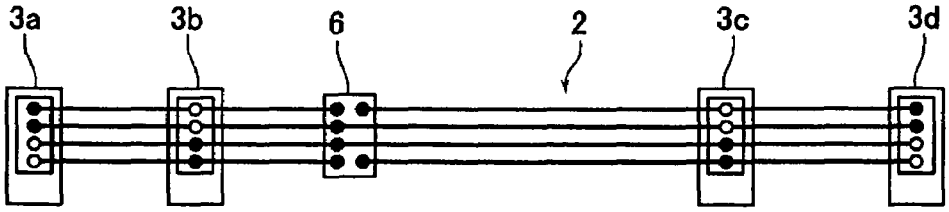
FIG. 7B is a schematic drawing for explaining another conductor reduction state of the flat cable.

As shown in FIG. 6A, for example, in a conventional flat harness 91, the relay connector 6 is crimped to the end part of the flat cable 2, and four conductors (4*a* to 4*d*) are provided in the flat cable 2, where the connector 3*a* is connected to the conductors 4*a* and 4*b*, the connector 3*b* is connected to conductor 4*b*, the connector 3*c* is connected to conductor 4*d*, and the connector 3*d* is connected to conductor 4*c*, the conductors in the part shown by the bolded line in the figure are unnecessary. Thus, as shown in FIG. 6B, if a structure is used wherein the relay connector 6 is crimped between connectors 3*b* and 3*c* and the conductors are cut at the installation part, only two conductors in the flat cable 2 are needed that previously required four conductors. Similarly, as shown in FIG. 7, in the conventional harness 92, the relay conductor 6 is crimped between the connectors 3*b* and 3*c* of the flat cable 2, and six conductors (4*a* to 4*f*) are provided in the flat cable 2, where the connector 3*a* is connected to conductors 4*a* and 4*b*, the connector 3*b* is connected to conductors 4*d* and 4*f*, the connector 3*c* is connected to conductors 4*e* and 4*f*, and the connector 3*d* is connected to conductors 4*a* and 4*c*, the conductors in the parts shown by the bolded lines are unnecessary. Thus, as shown in FIG. 7B, if a structure is used in which predetermined conductors are cut at the installation part of the relay connector 6, only four conductors in the flat cable 2 are needed that previously required six conductors. In this manner, by cutting predetermined conductors at the installation part of the relay connector 6, it is possible to decrease the unnecessary material for the conductors and the like in the flat cable 2 that forms the flat harness 1.

FIG. 8A to FIG. 9B are drawings for explaining a part of the manufacturing steps for the flat harness according to an embodiment of the present invention.

Figure 8A:
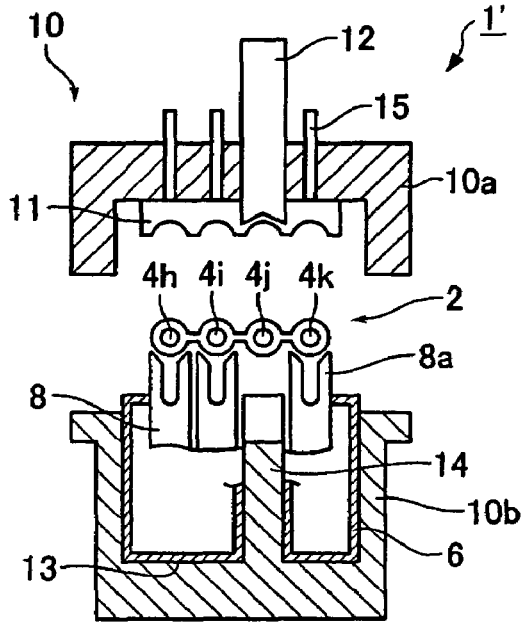
FIG. 8A is a drawing for explaining the part of the manufacturing steps for the flat harness according to an embodiment of the present invention.

In the installation steps of the relay connector 6 of the flat harness 1', for example, as shown in FIG. 8A, an assembly 10 consisting of an upper assembly 10*a* and a lower assembly 10*b* is used. In the installation step in this example, the crimping of each conductor (4*h*, 4*i*, 4*j*, and 4*k*) to the relay connection terminal 8 provided on the relay connector 6 and the cutting of the predetermined conductor 4*j* take place in one step. Moreover, on the upper assembly 10*a* that forms the assembly 10 in this example, a conductor restraining part 11 for restraining each of the conductors 4*h* to 4*k* of the flat cable 2 with respect to the lower assembly 10*b*, a crimping press form 15 for crimping each of the conductors 4*h* to 4*k* to the relay connecting terminal 8, and a cutting blade form 12 that can move in a direction perpendicular to the direction that the conductors of the flat cable 2 are arranged (the direction of the arrow in the figure) to the position corresponding to the conductor to be cut. In addition, at the lower assembly 10*b*, a connector engagement hole 13 for installing the relay connector 6 on the lower assembly 10*b* and a stopper 14 for determining the range of movement of the cutting blade form 12 in the direction of the lower assembly 10*b* are provided. Moreover, the cutting blade form 12 provides a plurality of blade ends in the longitudinal direction of the conductors 4 so as to cut off a predetermined section of the conductors 4. Moreover, each of the conductors 4*a* to 4*e* that form the flat cable 2 described above are not necessarily identical to each of the conductors 4*h* to 4*k* that form the flat cable 2 in this example, and in addition, the installation state of the relay connector 6 is not necessarily identical to that of the flat harness 1 or the flat harness 1'.

First, the flat cable 2 is mounted on the lower assembly 10*b* such that the relay connector 6 that provides the relay connection terminal 8 is installed in a state wherein the crimped part 8*a* of the relay connection terminal 8 is exposed from the connector engagement hole 13 at the connection engagement hole 13 of the lower assembly 10*b* and the installation part of the relay connector 6 in the flat cable 2 is positioned corresponding to the relay connector 6. Here, the relay connection terminal 8 in this example is a crimping terminal (a forked terminal) wherein the distal end of the crimping part 8*a* thereof is divided into two branches, and the ends thereof are crimped with the conductor 4 interposed therebetween.

Figure 8B:
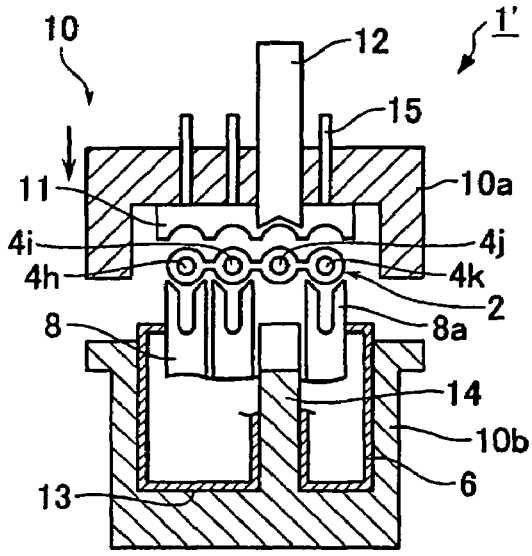
FIG. 8B is a drawing for explaining the part of the manufacturing steps for the flat harness according to an embodiment of the present invention.
Figure 8C:
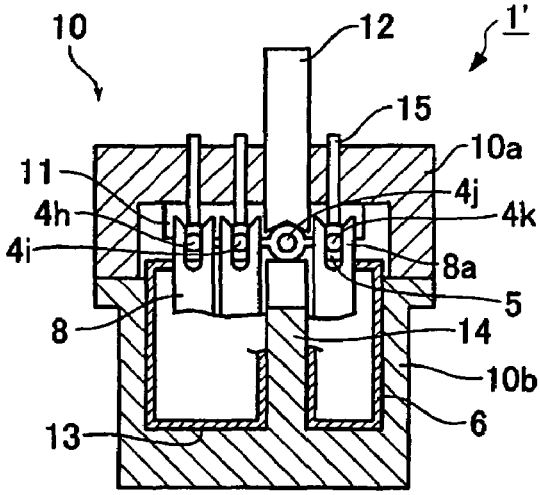
FIG. 8C is a drawing for explaining the part of the manufacturing steps for the flat harness according to an embodiment of the present invention.
Figure 8D:
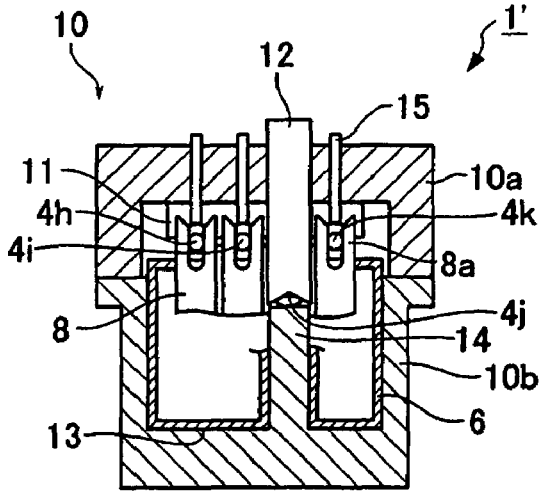
FIG. 8D is a drawing for explaining the part of the manufacturing steps for the flat harness according to an embodiment of the present invention.

Next, as shown in FIG. 8B, the upper assembly 10*a* is moved in the direction of the lower assembly 10*b* (the direction of the arrow in the figure), and as shown in FIG. 8C, the upper assembly 10*a* abuts the lower assembly 10*b*. At this time, the conductor restraining part 11 of the upper assembly 10*a* presses each of the conductors 4*h* to 4*k* against the lower assembly 10*b*, and thereby the flat cable 2 is fastened to the assembly 10. In addition, when the crimping press form 15 is slid in the direction of the lower assembly 10*b*, each of the conductors 4*h* to 4*k* are pressed against the crimping part 8*a* of the relay connection terminal 8, and thereby the crimping part 8*a* breaks the insulation covers 5 of each of the conductors 4*h* to 4*k* to crimp them (the conductor 4*j* is not illustrated). Furthermore, simultaneously to the crimping of these conductors 4*h* to 4*k*, as shown in FIG. 8D, the cutting blade form 12 of the upper assembly 10*a* is slid in the direction of the lower assembly 10*b*, and the predetermined section of the conductor 4*j* is cut by the blade end and falls onto the stopper 14. In this manner, by using the assembly 10, it is possible to carry out the crimping step of the conductor 4 of the flat cable 2 and the relay connection terminal 8 and the cutting step of the conductor 4 in one step, and therefore, the number of manufacturing steps for the flat cable 1' can be decreased. Moreover, the cutting of the conductors 4 described above is not limited to cutting off a predetermined segment as described above, but a partial cutting in which a notch is imparted can be carried out. In addition, although not illustrated, in proximity to the respective cut parts of the conductor 4*j* whose predetermined segment has been cut off and separated, the relay connection terminals 8, not illustrated, are crimped in the same manner as described above.

Figure 9A:
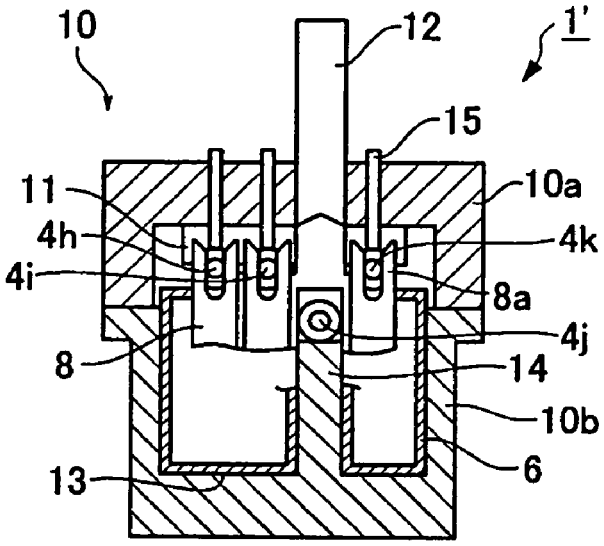
FIG. 9A is a drawing for explaining a part of the manufacturing steps for the flat harness according to an embodiment of the present invention.
Figure 9B:
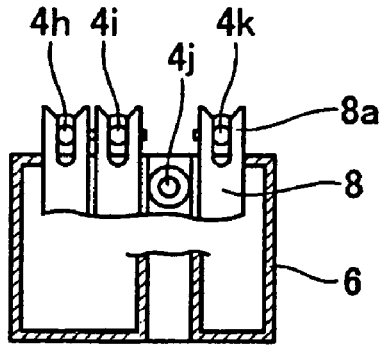
FIG. 9B is a drawing for explaining a part of the manufacturing steps for the flat harness according to an embodiment of the present invention.

In addition, as shown in FIG. 9A, by sliding the cutting blade form 12 in the direction in which it becomes separated from the lower assembly 10*b* and the relay connector 6 is extracted from the connector engagement hole 13 by separating the upper assembly 10*a* and the lower assembly 10*b*, it is possible to manufacture a harness 1' consisting of a flat cable 2 in which the conductors 4*h* to 4*k* of the flat cable 2 are connected to the relay connection terminal 8 and the relay connector 6 is mounted at a predetermined position in a state wherein a predetermined segment of the conductor 4*j* has been cut.

FIG. 10A to FIG. 11D are drawings for explaining a part of the manufacturing step for the flat harness according to another embodiment of the present invention. Moreover, in the following description, explanations that repeat portions of the parts already explained will be omitted as far as possible.

Figure 10A:
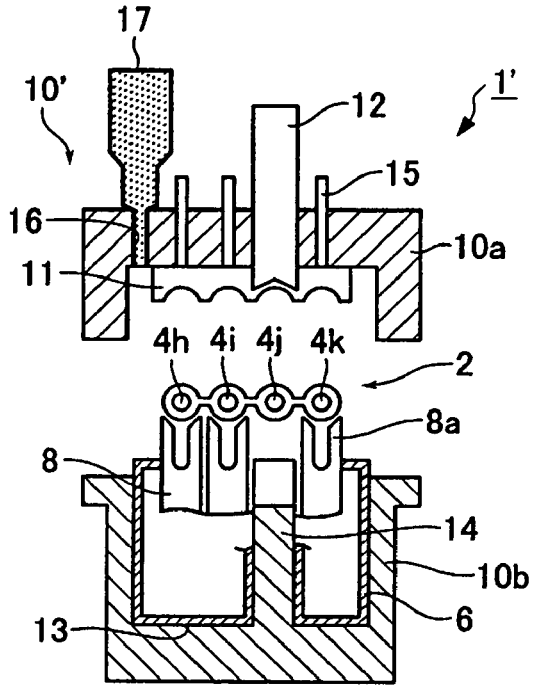
FIG. 10A is a drawing for explaining a part of the manufacturing steps for the flat harness according to another embodiment of the present invention.

The installation step of the relay connector 6 of the flat harness 1' carries out in one step the crimping, cutting, and molding as described above. In this installation step, as shown in FIG. 10A, an assembly 10' consisting of an upper assembly 10*a* and a lower assembly 10*b* whose structure is identical to the assembly 10 described above, except that a mould injection hole 16 is provided in the upper assembly 10*a*. In the wiring step in this example, concretely the crimping of each of the conductors 4*h* to 4*k* of the relay connection terminal 8 provided on the relay connector 6, the cutting a predetermined conductor 4*j*, and the molding of the relay connection terminal 8 and the connection parts of each of the conductors 4*h* to 4*k* are carried out in one step.

Figure 10B:
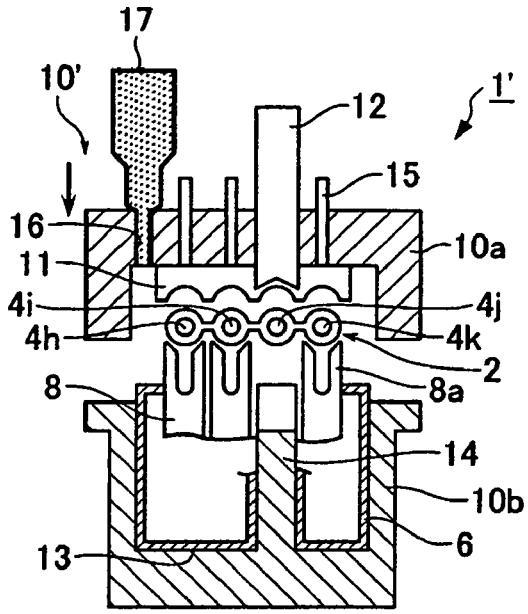
FIG. 10B is a drawing for explaining a part of the manufacturing steps for the flat harness according to another embodiment of the present invention.

First, as shown in FIG. 10A, the relay connector 6 providing the relay connection terminal 8 is installed in the connector engagement hole 13 of the lower assembly 10*b*, the flat cable 2 is mounted on the lower assembly 10*b* so that the installation part of the relay connector 6 in the flat cable 2 is positioned corresponding to the relay connector 6, and as shown in FIG. 10B, the upper assembly 10*a* is moved in the direction of the lower assembly 10*b* (the direction of the arrow in the drawing). Moreover, the injection distal end part 17 of the mold injection apparatus (not illustrated) is engaged in the mould injection hole 16 of the upper assembly 10*a*.

Figure 10C:
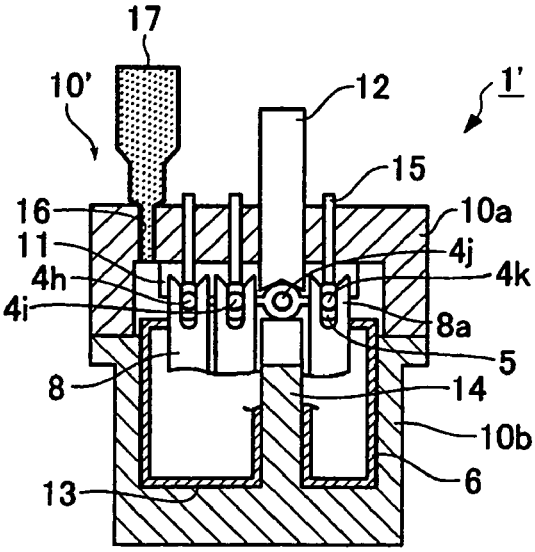
FIG. 10C is a drawing for explaining a part of the manufacturing steps for the flat harness according to another embodiment of the present invention.
Figure 10D:
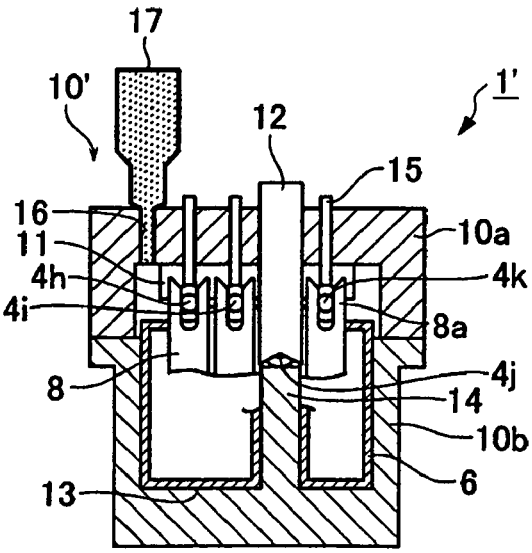
FIG. 10D is a drawing for explaining a part of the manufacturing steps for the flat harness according to another embodiment of the present invention.

Next, as shown in FIG. 10C, the upper assembly 10*a* and the lower assembly 10*b* are abutted, and the flat cable is fastened to the assembly 10' by the conductor restraining part 11. Then the crimping press form 15 is slid in the direction of the lower assembly 10*b*, and each of the conductors 4*h* to 4*k* is pressed and crimped to the crimping part 8*a* of the relay connection terminal 8 (illustration of conductor 4*j* is omitted). Simultaneously, as shown in FIG. 10D, the cutting blade form 12 of the upper assembly 10*a* is slid to cut a predetermined segment of the conductor 4*j*. As a result, the predetermined segment of the cut conductor 4*j* is cut and falls onto the stopper 14.

Figure 11A:
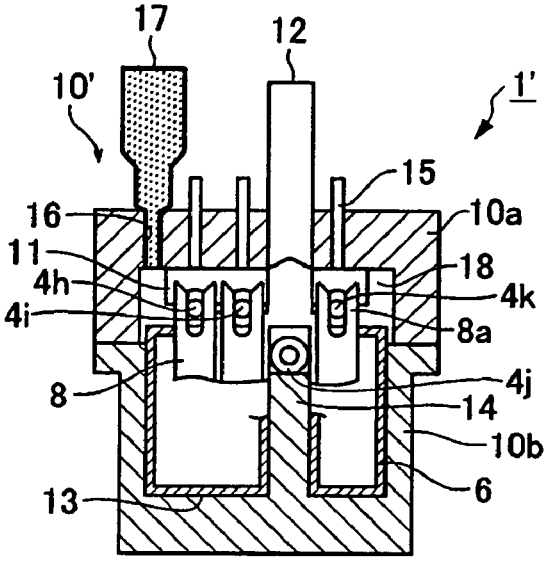
FIG. 11A is a drawing for explaining a part of the manufacturing steps for the flat harness according to another embodiment of the present invention.
Figure 11B:
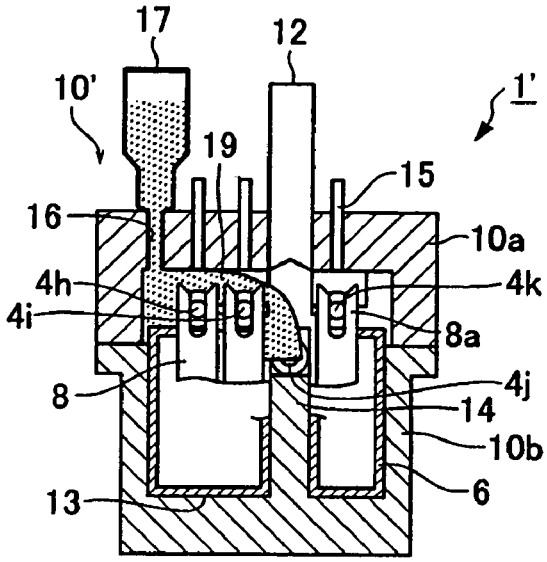
FIG. 11B is a drawing for explaining a part of the manufacturing steps for the flat harness according to another embodiment of the present invention.
Figure 11C:
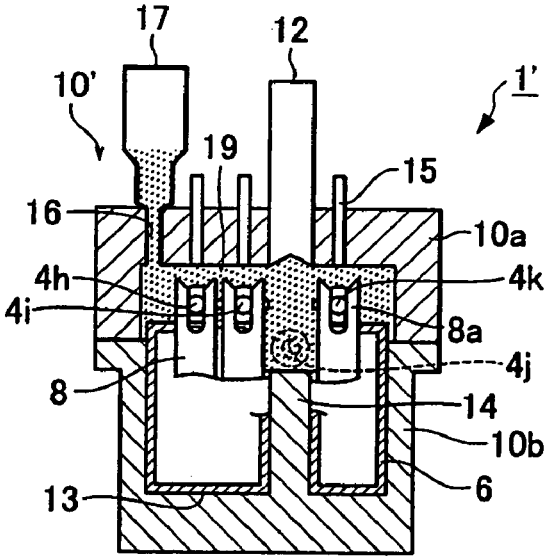
FIG. 11C is a drawing for explaining a part of the manufacturing steps for the flat harness according to another embodiment of the present invention.
Figure 11D:
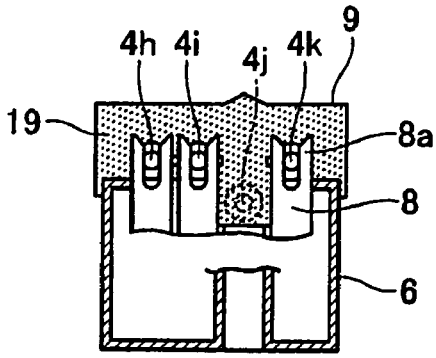
FIG. 11D is a drawing for explaining a part of the manufacturing steps for the flat harness according to another embodiment of the present invention.

When the predetermined segment of the conductor 4*j* has been cut, as shown in FIG. 11A, the crimping press form 15 and the cutting blade form 12 are raised, and a space 18 is formed in the connection part between each of the conductors 4*h* to 4*k* and the relay connection terminal 8. Then, as shown in FIG. 11B, a mould resin 19 is injected from the injection end part 17 through the mould injection hole 16 into the space 18. In this example, a hot melt resin is used as the mould resin. As shown in FIG. 11C, this mould resin 19 is injected until it fills the space 18, and the connection parts between the relay connection terminal 8 and each of the conductors 4*h* to 4*k* is sealed. In addition, the cutting scraps of the conductor 4*j* that have been cut and fallen on the stopper 14 are incorporated. Finally, as shown in FIG. 10D, the mould resin 19 that has filled the space 18 hardens, and the flat harness 1' is manufactured by forming the mould part 9. Here, the cutting scraps of the conductor 4*j* are sealed in the mould part 9 so as to be enclosed by the mould resin 19, and thus there is no concern about a short circuit or the like. Of course, the connection parts of each of the conductors 4*h* to 4*k* are also sealed by the mould part 19, and thus they will not short circuit. According to the wiring step of the relay connector 6, the crimping, cutting, and molding step can be carried out in one step, and the step of eliminating the cutting scraps of the conductor 4*j* can be eliminated. Thus, the number of manufacturing steps of the flat harness 1' can be even further decreased.

Figure 12A:
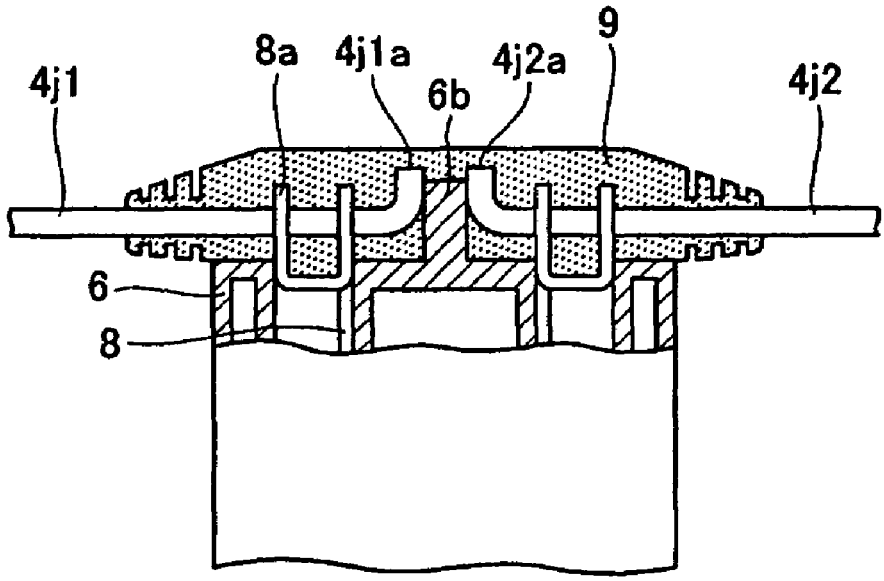
FIG. 12A is a partial cross-sectional drawing for explaining the sealed state of the conductor cut by the mold.
Figure 12B:
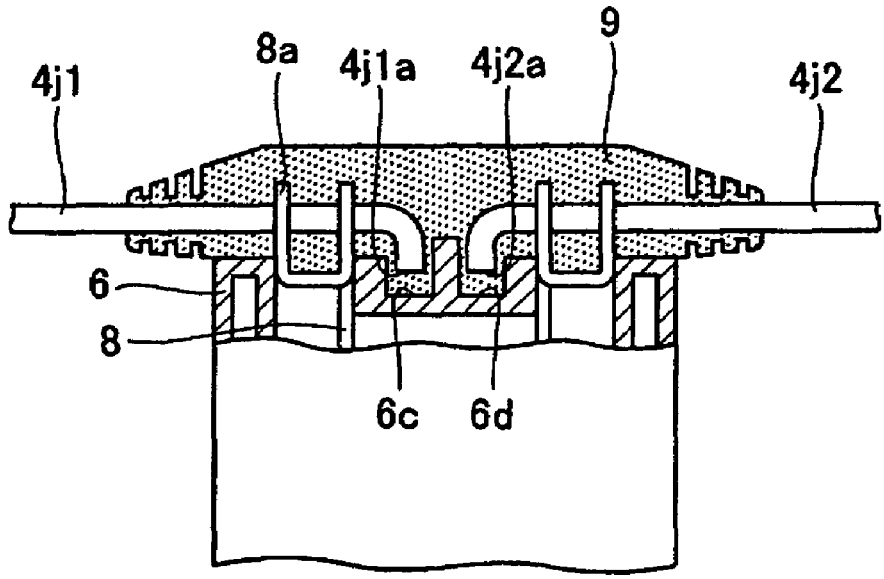
FIG. 12B is a partial cross-sectional drawing for explaining the sealed state of the conductor cut by the mold.

Furthermore, in the case that the conductor 4*j* is simply cut, each of the cut parts of the cut conductor 4*j* can be sealed by the mold part 9 as shown in FIG. 12A and FIG. 12B. That is, as shown in FIG. 12A, in the installation part of the relay connector 6 in the flat cable 2, the areas near the cut parts of each of the conductors 4*j*1 and 4*j*2 are each connected to the crimping parts 8*a* of the relay connection terminal 8 and bent in an upward direction in the figure and sealed so that the cut surfaces 4*j*1*a* and 4*j*2*a* thereof do not contact or face each other. In this case, a rib 6*b* can be formed on the relay connector 6 in order to maintain this bent state. In contrast, in the case that the cut surfaces 4*j*1*a* and 4*j*2*a* of the conductors 4*j*1 and 4*j*2 are bent in the downward direction in the figure and sealed so as not to contact or face each other, as shown in FIG. 12B, recesses 6*c* and 6*d* that engage the bent ends of the conductors 4*j*1 and 4*j*2 can be formed in the relay connector 6. In this manner, short-circuiting or the like of the conductors 4*j*1 and 4*j*2 can certainly be prevented.

Figure 13:
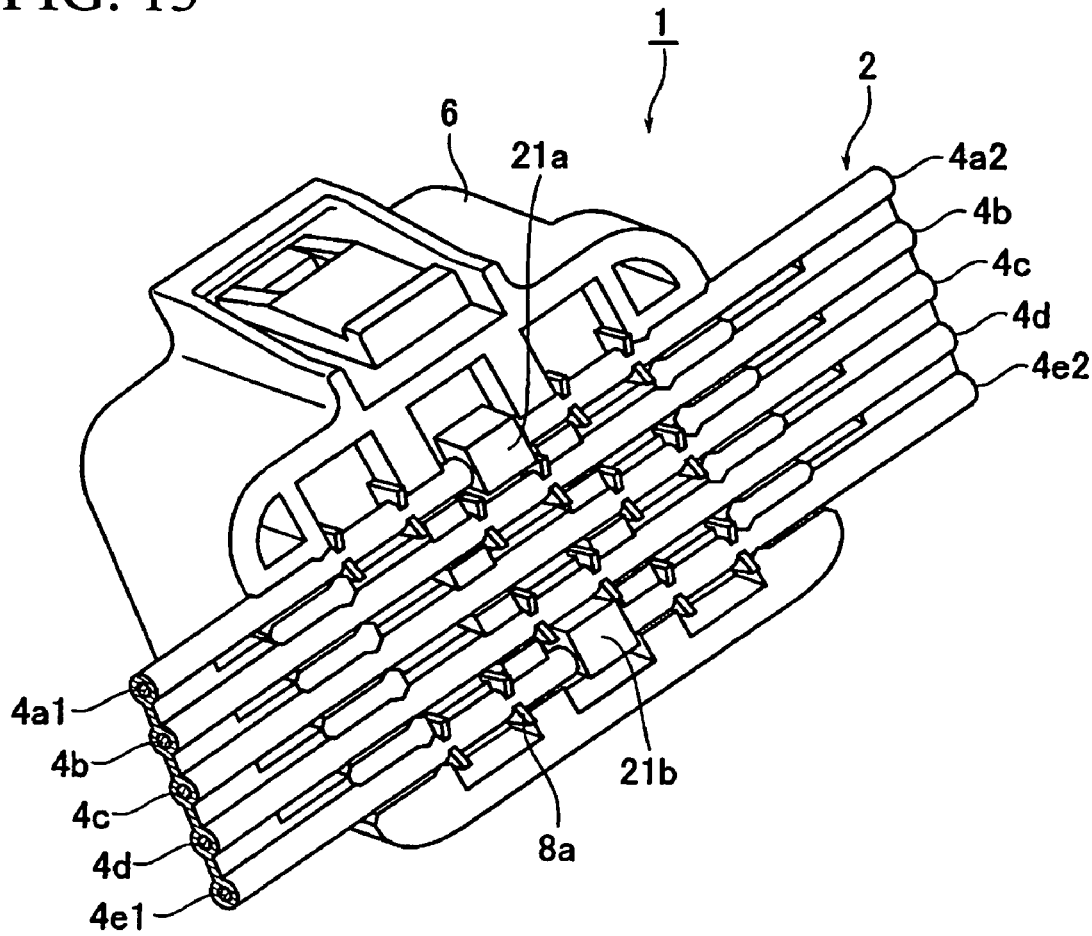
FIG. 13 is a perspective drawing showing the connection part between the flat cable and another relay connector.
Figure 14:
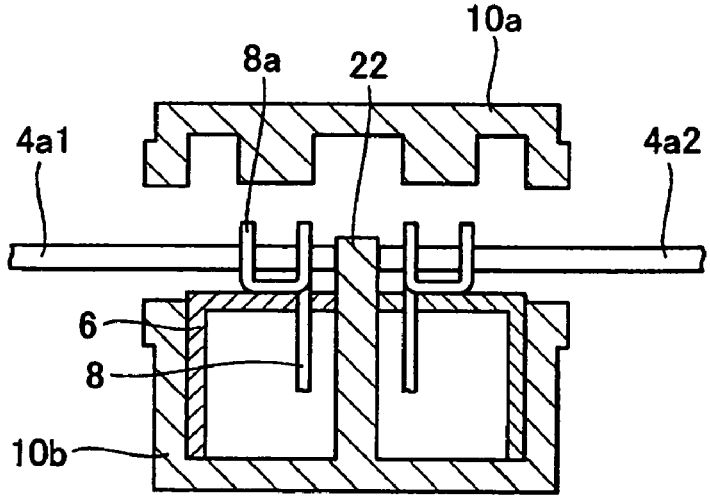
FIG. 14 is a partial cross-sectional drawing showing a part of the manufacturing steps for the flat harness.

In addition, when the predetermined segment of the predetermined conductor 4 has been cut off, if a projection that fits into the predetermined segment thereof is formed on the relay connector 6, the connection between the flat cable 2 and the relay connection terminal 8 can be positioned. For example, in the case that this projection is formed on the relay connector shown in FIG. 4, as shown in FIG. 13, when the formed projections 21*a* and 21*b* are crimped with the relay connection terminal 8 after inserting them in the area between the conductors 4*a*1 and 4*a*2 and the area between the conductors 4*e*1 and 4*e*2, it is possible to carry out positioning of the connections. Also in the case that projections 21*a* and 21*b* are not formed on the relay connector 6, as shown in FIG. 14, if, for example, a positioning wall 22 is formed in the lower assembly 10*b* and the crimping step is carried out by mounting the flat cable 2 on the lower assembly 10*b* so that this positioning wall 22 fits between the conductors 4*a*1 and 4*a*2, it is possible to position the connection with the relay connection terminal 8.

FIG. 15A to FIG. 16C are drawings for explaining a part of the manufacturing steps for the flat harness according to yet another embodiment of the present embodiment.

In the example described above, the installation step of the relay connector 6 of the flat cable 1' has been explained, however, here the installation step for the connectors 3*a* to 3*d* of the flat cable 1' will be explained. In the installation step for connectors 3*a* to 3*d* of the flat harness 1', an assembly 10" is used that consists of an upper assembly 10*a* and a lower assembly 10*b* as shown for example in FIG. 15A. In this installation step, an assembly 10" is used that consists of an upper assembly 10*a* and a lower assembly 10*b* having a structure identical to that of the assembly 10' described above, except that the cutting blade form 12 of the upper assembly 10*a* and the stopper 14 in the lower assembly 10*b* are not provided.

In this example of the installation step, the crimping of each of the conductors 4*h* to 4*k* to the connection terminals 20 provided on the connectors 3*a* to 3*d* and the molding of these connection parts can be carried out in one step. Moreover, in each of the connectors 3*a* to 3*d*, actually among the conductors 4*h* to 4*k* that form the flat cable 2, the connection terminal 20 only needs to be connected to at least one conductor, and thus there are cases that differ here from the installation state explained above. In addition, in this example, only the installation of the connector 3*a* is explained.

Figure 15A:
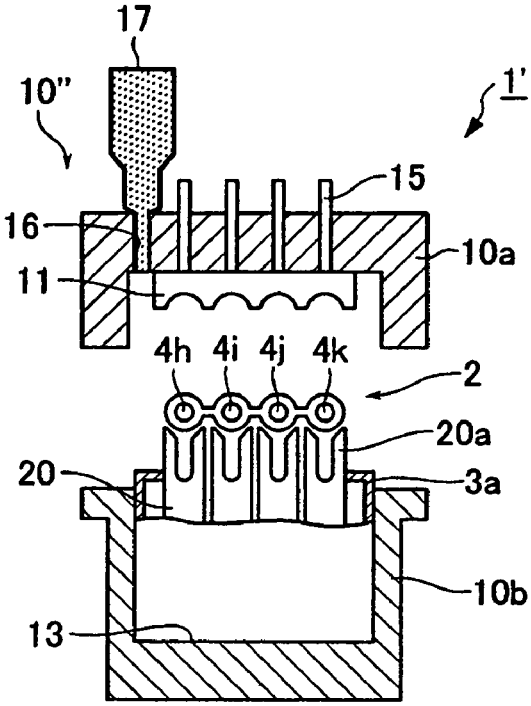
FIG. 15A is a drawing for explaining a part of the manufacturing steps for the flat harness according to yet another embodiment of the present invention.

First, as shown in FIG. 15A, the flat cable 2 is mounted on the lower assembly 10*b* such that the connector 3*a* that provides a connection terminal 20 in the connector engagement hole 13 of the lower assembly 10*b* is installed so that the crimping part 20*a* of the connection terminal 20 is exposed from the connector engagement hole 13 and the installation part of the connector 3*a* in the flat cable 2 is positioned corresponding to the connector 3*a*. Here, the connection terminal 20 in this example is a crimping terminal (forked terminal) in which the distal end of the crimping part 20*a* thereof is divided into two branches and the end parts thereof are crimped with the conductor 4 interposed therebetween.

Figure 15B:
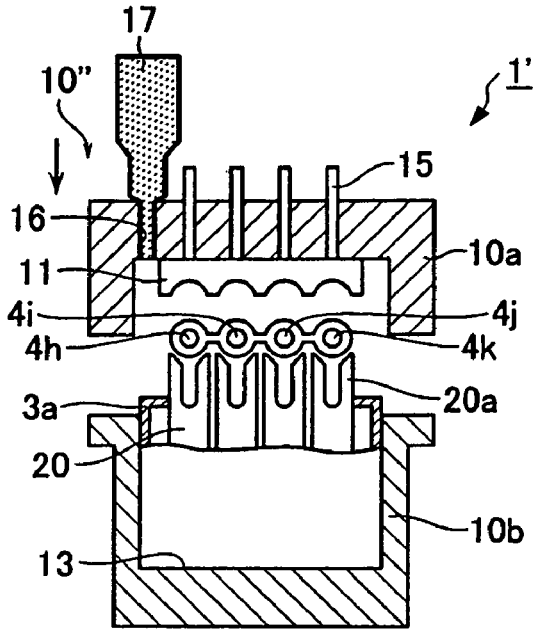
FIG. 15B is a drawing for explaining a part of the manufacturing steps for the flat harness according to yet another embodiment of the present invention.
Figure 15C:
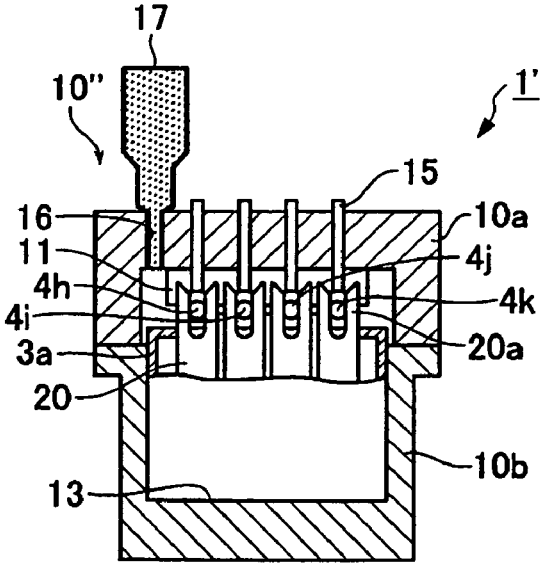
FIG. 15C is a drawing for explaining a part of the manufacturing steps for the flat harness according to yet another embodiment of the present invention.
Figure 15D:
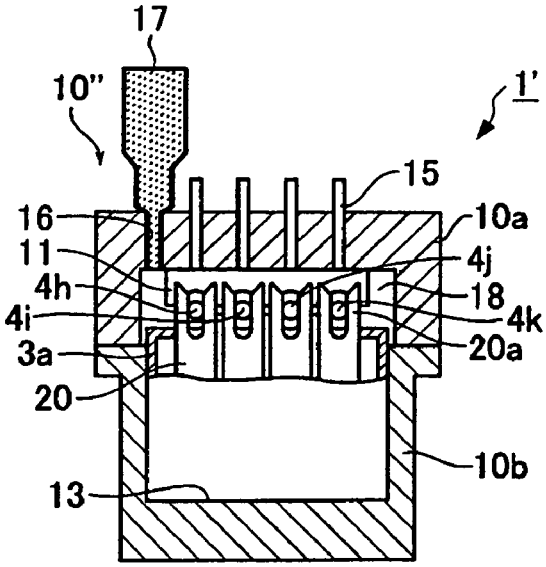
FIG. 15D is a drawing for explaining a part of the manufacturing steps for the flat harness according to yet another embodiment of the present invention.

Next, as shown in FIG. 15B, the upper assembly 10*a* is moved in the direction of the lower assembly 10*b* (the direction of the arrow in the figure), and as shown in FIG. 15C, the upper assembly 10*a* abuts the lower assembly 10*b*, each of the conductors 4*h* to 4*k* are pressed by the conductor restraining part 11, and the flat cable 2 is fastened to the assembly 10". Then, the crimping press form 15 is slid in the direction of the lower assembly 10*b*, and each of the conductors 4*h* to 4*k* are crimped and connected to the crimping part 20*a* of the connection terminal 20. When each of the conductors 4*h* to 4*k* have been crimped to the connecting terminal 20, as shown in FIG. 15D, the crimping press form 15 is raised, and the space 18 in the connection part between each of the conductors 4*h* to 4*k* and the connection terminal 20 is formed.

Figure 16A:
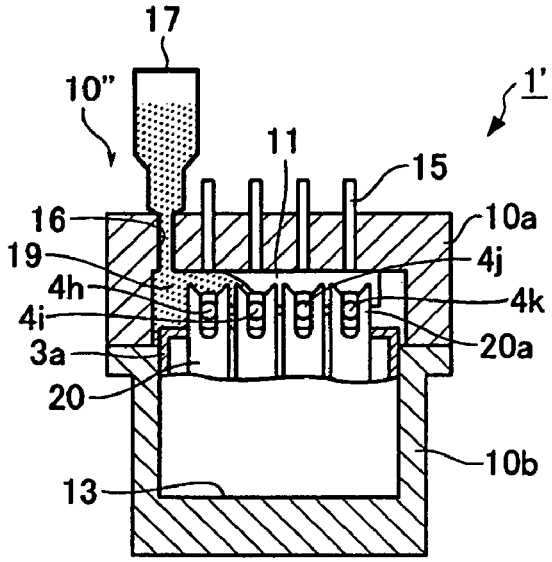
FIG. 16A is a drawing for explaining a part of the manufacturing steps of the flat harness according to yet another embodiment of the present invention.
Figure 16B:
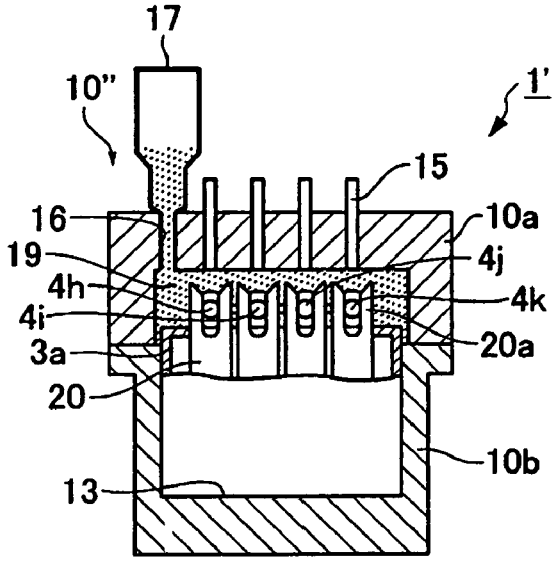
FIG. 16B is a drawing for explaining a part of the manufacturing steps of the flat harness according to yet another embodiment of the present invention.
Figure 16C:
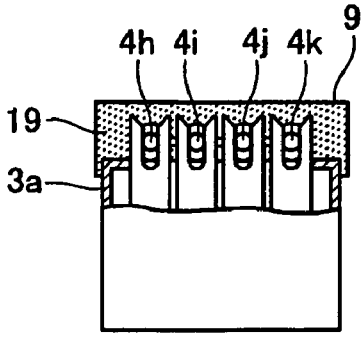
FIG. 16C is a drawing for explaining a part of the manufacturing steps of the flat harness according to yet another embodiment of the present invention.

When the space 18 is formed, as shown in FIG. 16A, a mold resin 19 is injected from the injection distal end part 17 through the mold injection hole 16 into the formed space 18, and as shown in FIG. 16B, the space 18 is filled with the mold resin 19. This mold resin 19 seals the connection parts between the connection terminal 20 and each of the conductors 4*h* to 4*k*. Finally, as shown in FIG. 16C, the mold resin 19 that fills the space 18 is hardened, and the flat harness 1' is manufactured by forming the mold part 9. According to the installation step for the connectors 3*a* to 3*d*, it is possible to carry out the crimping and molding steps in one step, and thus the number of manufacturing steps for the flat harness 1' can be decreased.

Although exemplary embodiments of the present invention have been described with reference to the drawings, the present invention is not limited by the embodiments and the drawings. It will be apparent that those skilled in the art can make various modifications and changes within the technical spirit and scope of the invention.

What is claimed is:

1. A manufacturing method for a harness, said harness comprising a cable and a plurality of connectors installed at locations along the longitudinal direction of said cable, said cable comprising a plurality of conductors surrounded by an insulating covering and arrayed in a substantially flat configuration, and said plurality of connectors comprising connection terminals that connect to at least one of said plurality of conductors in order to connect external circuits to said at least one of said plurality of conductors, said method comprising:

a connector installation step of installing each of said plurality of connectors at predetermined positions in the longitudinal direction of said cable such that said connection terminals and said at least one of said plurality of conductors are connected; and a conductor cutting step of cutting a selected one of said plurality of conductors at a point between the plurality of connection terminals that are disposed along said cut conductor, wherein said connector installation step further includes a molding step in which the proximal ends of the connection terminals connected to the conductors of said cable are sealed by placing each of the plurality of connectors into a respective mold assembly, injecting a resin onto each of the connectors, and removing each of the connectors from the mold assembly, and wherein said molding step also comprises a bending step of bending said selected one of said conductors that has been cut and separated in said conductor cutting step such that the respective cut surfaces do not contact and do not face each other, and sealing each of said bent conductors in an enclosed state such that said cut surfaces are each encased in the resin.

2. A manufacturing method for a harness according to claim 1, wherein the conductor cutting step and the connector installation step are performed at the same time.

3. A manufacturing method for a harness according to claim 1, wherein the conductor cutting step is performed before the connector installation step.

4. A manufacturing method for a harness according to claim 1, wherein the harness further comprises a relay connector, the relay connector is installed at a predetermined position on the cable during the connector installation step;

and the conductor cutting step is performed on a portion of the selected one of said plurality of conductors located within the relay connector.

5. A manufacturing method for a harness according to claim 1, wherein cutting scraps of said selected one of said plurality of conductors cut in said conductor cutting step are sealed with the proximal ends of the connection terminals in said molding step.

6. A manufacturing method for a harness according to claim 1, wherein said connection terminals are crimping-style terminals having a crimping part in which insulating coating of the cable is held at the proximal side and the conductors are interposed therebetween, and said connector installation step is a crimping step in which each of the conductors is interposed in the crimping part of the connection terminals and crimped.

* * * * *